US008894247B2

(12) United States Patent
Kim et al.

(10) Patent No.: US 8,894,247 B2
(45) Date of Patent: Nov. 25, 2014

(54) OPTICAL SEMICONDUCTOR LIGHTING APPARATUS

(71) Applicant: Posco LED Company Ltd., Seongnam-si (KR)

(72) Inventors: Dong-Soo Kim, Ansan-si (KR); Seok-Jin Kang, Seoul (KR); Min-A Jeong, Seongnam-si (KR)

(73) Assignee: Posco LED Co., Seongnam-si (KR)

( * ) Notice: Subject to any disclaimer, the term of this patent is extended or adjusted under 35 U.S.C. 154(b) by 0 days.

(21) Appl. No.: 13/749,316

(22) Filed: Jan. 24, 2013

(65) Prior Publication Data

US 2013/0128589 A1 May 23, 2013

Related U.S. Application Data

(62) Division of application No. 13/198,963, filed on Aug. 5, 2011.

(30) Foreign Application Priority Data

| | | |
|---|---|---|
| Aug. 6, 2010 | (KR) | 10-2010-0076098 |
| Apr. 22, 2011 | (KR) | 10-2011-0037792 |
| May 18, 2011 | (KR) | 10-2011-0046902 |

(51) Int. Cl.

| | |
|---|---|
| ***F21V 29/02*** | (2006.01) |
| ***F21S 8/02*** | (2006.01) |
| ***F21V 29/00*** | (2006.01) |
| ***F21V 7/20*** | (2006.01) |
| *F21Y 101/02* | (2006.01) |

(52) U.S. Cl.

CPC ..... *F21V 29/025* (2013.01); *F21S 8/026* (2013.01); *F21V 29/02* (2013.01); *F21V 29/2268* (2013.01); *F21V 7/20* (2013.01); *F21V 29/027* (2013.01); *F21Y 2101/02* (2013.01)

USPC ..... 362/294; 362/311.02; 361/697

(58) Field of Classification Search

USPC ..... 362/373, 294.02, 311.02, 800, 547, 362/218, 264, 345; 361/695, 697, 703, 704, 361/707, 709

See application file for complete search history.

(56) References Cited

U.S. PATENT DOCUMENTS

| | | | | |
|---|---|---|---|---|
| 4,142,227 | A * | 2/1979 | Aikens | 362/480 |
| 4,630,182 | A * | 12/1986 | Moroi et al. | 362/294 |

(Continued)

FOREIGN PATENT DOCUMENTS

| | | |
|---|---|---|
| CN | 201203004 | 3/2009 |
| JP | 1993-015210 | 2/1993 |

(Continued)

OTHER PUBLICATIONS

Final Office Action issued in U.S. Appl. No. 13/198,963 on Apr. 10, 2013.

(Continued)

*Primary Examiner* — Diane Lee
*Assistant Examiner* — Gerald J Sufleta, II
(74) *Attorney, Agent, or Firm* — H.C. Park & Associates, PLC

(57) ABSTRACT

An optical semiconductor lighting apparatus including a housing with a first end portion and a second end portion that is open, a light source module disposed in the housing, a fan disposed adjacent to the light source module in the housing, the fan rotating in a first direction to blow air toward the light source module, and a reflector disposed adjacent to the second end portion of the housing, the reflector enhancing an illumination scope. A moving path, in which at least a portion of the air drawn into the housing by the fan externally flows through the light source module, is formed in the housing.

13 Claims, 16 Drawing Sheets

(56) References Cited

U.S. PATENT DOCUMENTS

| | | | | |
|---|---|---|---|---|
| 5,909,087 | A | 6/1999 | Bryde et al. | |
| 6,161,946 | A | 12/2000 | Bishop et al. | |
| 7,144,140 | B2 | 12/2006 | Sun et al. | |
| 7,521,872 | B2 | 4/2009 | Bruning | |
| 7,543,961 | B2 | 6/2009 | Arik et al. | |
| 7,679,918 | B2 * | 3/2010 | Kim | 361/719 |
| 8,123,381 | B1 | 2/2012 | Wray | |
| 8,240,885 | B2 | 8/2012 | Miller | |
| 2003/0015361 | A1 * | 1/2003 | Bland | 180/68.1 |
| 2006/0193139 | A1 * | 8/2006 | Sun et al. | 362/373 |
| 2008/0025028 | A1 * | 1/2008 | Gloisten et al. | 362/294 |
| 2009/0040470 | A1 * | 2/2009 | Fukui et al. | 353/58 |
| 2009/0109625 | A1 | 4/2009 | Booth et al. | |
| 2010/0091500 | A1 * | 4/2010 | Herbst | 362/294 |
| 2010/0165632 | A1 * | 7/2010 | Liang | 362/294 |
| 2010/0259935 | A1 * | 10/2010 | Scordino et al. | 362/294 |
| 2011/0291588 | A1 | 12/2011 | Tagare | |
| 2012/0212960 | A1 | 8/2012 | Rodriguez | |
| 2012/0275164 | A1 | 11/2012 | Tseng et al. | |
| 2013/0044491 | A1 | 2/2013 | Chen et al. | |
| 2013/0051026 | A1 | 2/2013 | Yang | |
| 2013/0135868 | A1 | 5/2013 | Xue et al. | |

FOREIGN PATENT DOCUMENTS

| | | |
|---|---|---|
| JP | 1994-23120 | 3/1994 |
| JP | 1995-007017 | 1/1995 |
| JP | 07-260229 | 10/1995 |
| JP | 10-038361 | 2/1998 |
| JP | 10-208519 | 8/1998 |
| JP | 2008-103195 | 5/2008 |
| JP | 2008-192609 | 8/2008 |
| JP | 2009-289725 | 12/2009 |
| JP | U3158964 | 3/2010 |
| JP | 2010-153198 | 7/2010 |
| KR | 1020090000338 | 1/2009 |
| KR | 10-0900405 | 5/2009 |
| KR | 1020090114758 | 11/2009 |
| WO | 2009071110 | 6/2009 |

OTHER PUBLICATIONS

Non-Final Office Action issued Nov. 27, 2012 in U.S. Appl. No. 13/198,963.

Final Office Action issued on Jan. 31, 2014 in U.S. Appl. No. 13/748,981.

Final Office Action issued on Dec. 30, 2013 in U.S. Appl. No. 13/198,963.

Non-Final Office Action dated Jul. 5, 2013 in U.S. Appl. No. 13/748,981.

* cited by examiner

OPTICAL SEMICONDUCTOR LIGHTING APPARATUS

CROSS REFERENCE TO RELATED APPLICATIONS

This application is a divisional of U.S. application Ser. No. 13/198,963, filed on Aug. 5, 2011, and claims priority from and the benefit of Korean Patent Application No. 10-2010-0076098, filed on Aug. 6, 2010, Korean Patent Application No. 10-2011-0037792, filed on Apr. 22, 2011 and Korean Patent Application No. 10-2011-0046902, filed on May 18, 2011, which are all hereby incorporated by reference for all purposes as if fully set forth herein.

BACKGROUND OF THE INVENTION

1. Field of the Invention

The present invention relates to an optical semiconductor lighting apparatus. More particularly, the invention relates to an optical semiconductor lighting apparatus operable to be disposed in a workplace having air entrained particulates, to generate ambient light.

2. Discussion of the Background

Artificial light sources employed in lighting devices include an incandescent lamp, fluorescent lamp, etc. More recently, a light emitting diode (LED) element has been successfully employed as a light source. The LED element has many desirable advantages such as luminous efficiency, low power consumption, ecological friendliness, etc. Lighting apparatus including an LED element may be used for an indoor lamps in a home or office, or in a more industrial environment such as in a industrial workplace where automobiles are being assembled, iron smelting is occurring, textile sewing operations are taking place, etc. However, in many industrial plants dust, air entrained particulates or foreign substances may exist which may penetrate into a lighting to cause failure or inefficient operation of the lighting apparatus, or may be deposited on the surface of the lighting apparatus which tend to reduce luminous efficiency and heat dissipation efficiency. In addition, dust, air entrained particulates, foreign substances, etc. may stick to a reflector of a lighting fixture, to reduce reflection efficiency and heat dissipation efficiency of the reflector or as a minimum damage the appearance of the fixture.

Especially, in instances of a workplace environment with high ambient temperatures such as in iron production, for example, heated air rises and dust, air entrained particulates or foreign substances are born along with an ascending air current and can be deposited on a lighting element, a reflector, etc. of a lighting fixture.

Therefore, in order to prevent an accumulation of the dust, air entrained particulates, and other foreign substances it is a conventional maintenance requirement that a worker routinely clean lighting fixtures.

SUMMARY OF THE INVENTION

Exemplary embodiments of the present invention provide an optical semiconductor lighting apparatus capable of enhancing luminous efficiency, reflection efficiency, heat dissipation efficiency, and reducing maintenance cost by preventing dust, air entrained particulates, foreign substances and the like from penetrating into the optical semiconductor lighting apparatus or adhering to a reflector or other surfaces of the optical semiconductor lighting apparatus.

Additional features of the invention will be set forth in the description which follows, and will be apparent to one of ordinary skill in the art from the description and drawings of illustrative embodiments.

An exemplary embodiment of the present invention comprises an optical semiconductor lighting apparatus including a housing with a first end portion and a second end portion that is open, a light source module disposed in the housing, a fan disposed adjacent to the light source module in the housing, the fan rotating in a first direction to blow air toward the light source module, and a reflector disposed adjacent to the second end portion of the housing, the reflector enhancing an illumination scope. A moving path, in which at least a portion of the air drawn into the housing by the fan externally flows through the light source module is formed in the housing.

It is to be understood that both the foregoing general description and the following detailed description are exemplary and explanatory and are not intended to limit the scope of the invention which is defined by the claims.

BRIEF DESCRIPTION OF THE DRAWINGS

The accompanying drawings, which are included to provide an understanding of the invention constitute a part of this specification, illustrate exemplary embodiments of the invention, and together with the description serve to explain the principles of the invention, wherein.

DETAILED DESCRIPTION OF THE ILLUSTRATED EMBODIMENTS

Figure 1:
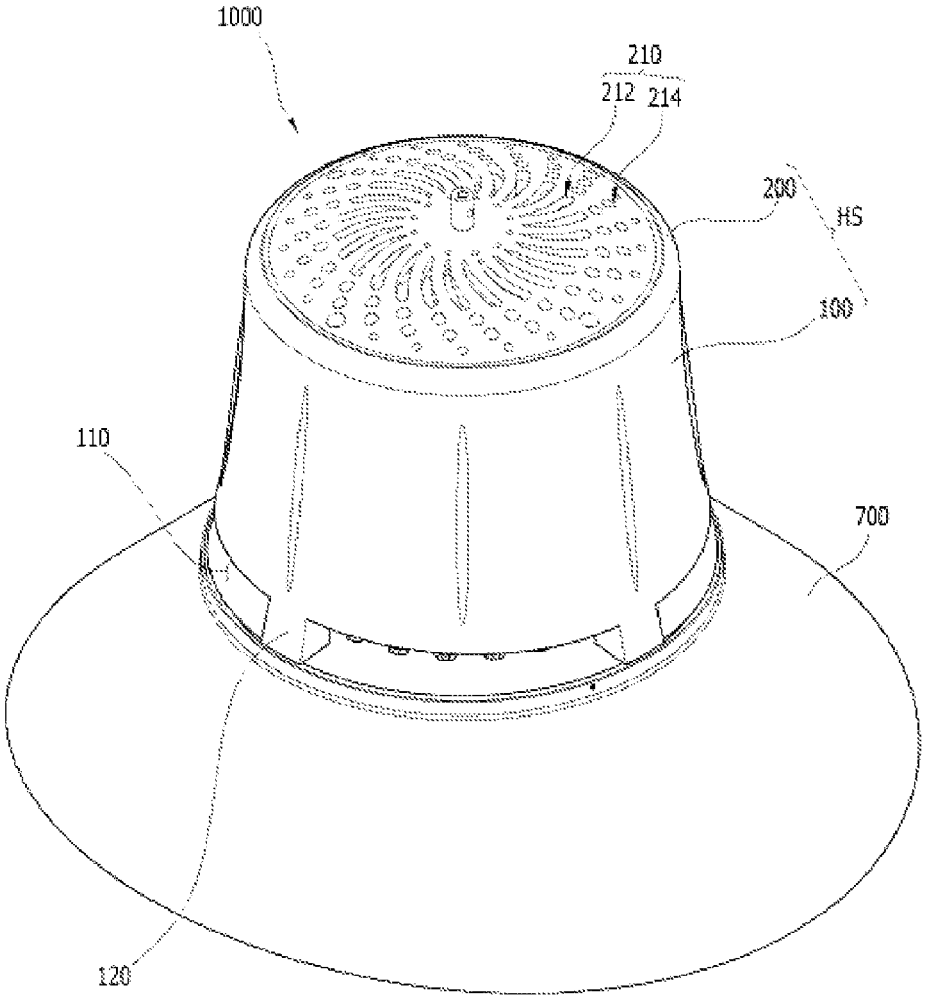
FIG. 1 is a perspective view illustrating an optical semiconductor lighting apparatus according to a first embodiment of the present invention.

The invention is described more fully hereinafter with reference to the accompanying drawings, in which exemplary embodiments of the invention are shown. This invention may, however, be embodied in many different forms and should not be construed as limited to the embodiments set forth in the specification. Rather, these exemplary embodiments are provided so that this disclosure will convey nature of the invention to those or ordinary skilled in the art. In the drawings, the size and relative sizes of layers and regions may be exaggerated for clarity. Like reference numerals in the drawings denote like exemplary components.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

As used in this application and claims the term "means" followed by a function is a reference to the structure disclosed here as the exemplary embodiments of the invention and in addition to equivalent structures for performing the recited function and is not intended to be limited just to structural equivalents of the exemplary embodiments.

Embodiment 1

Figure 2:
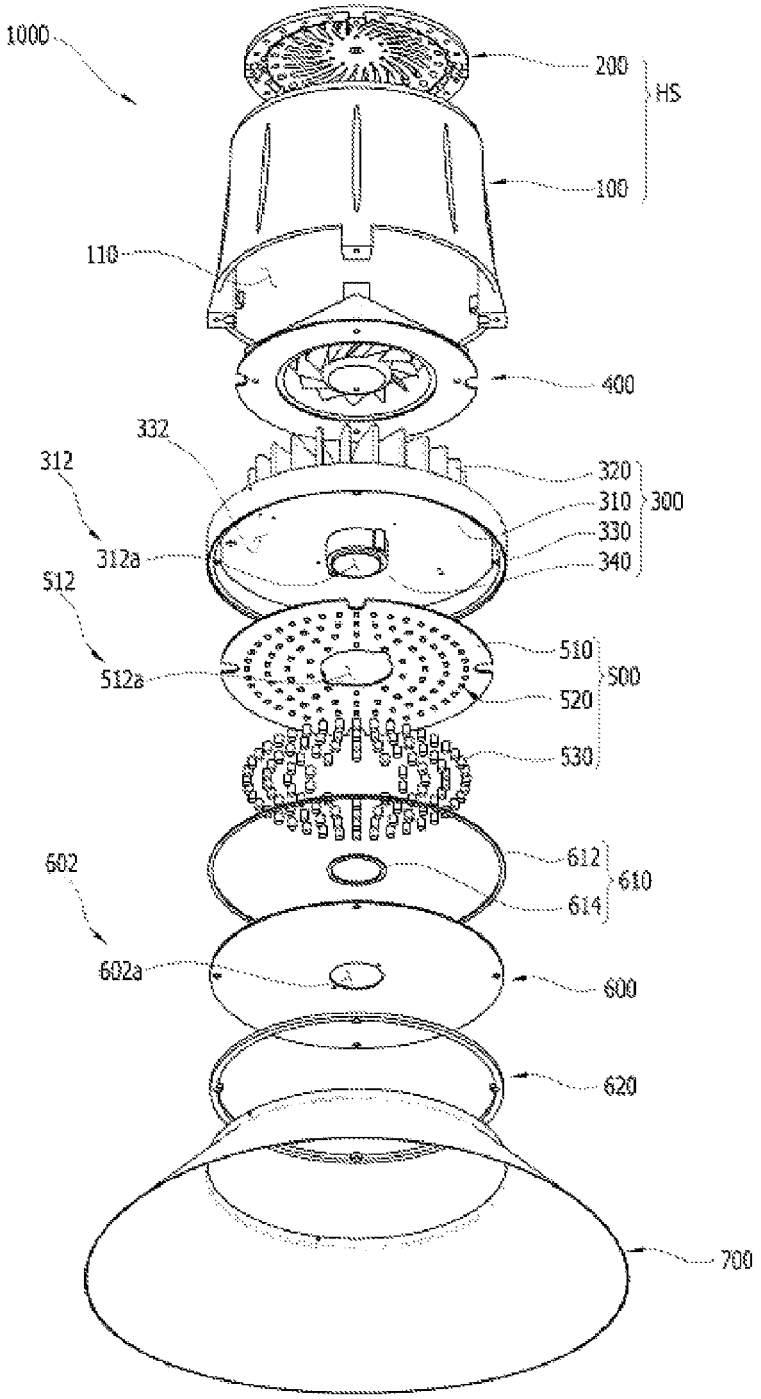
FIG. 2 is an exploded perspective view illustrating an optical semiconductor lighting apparatus as initially illustrated in FIG. 1.
Figure 3:
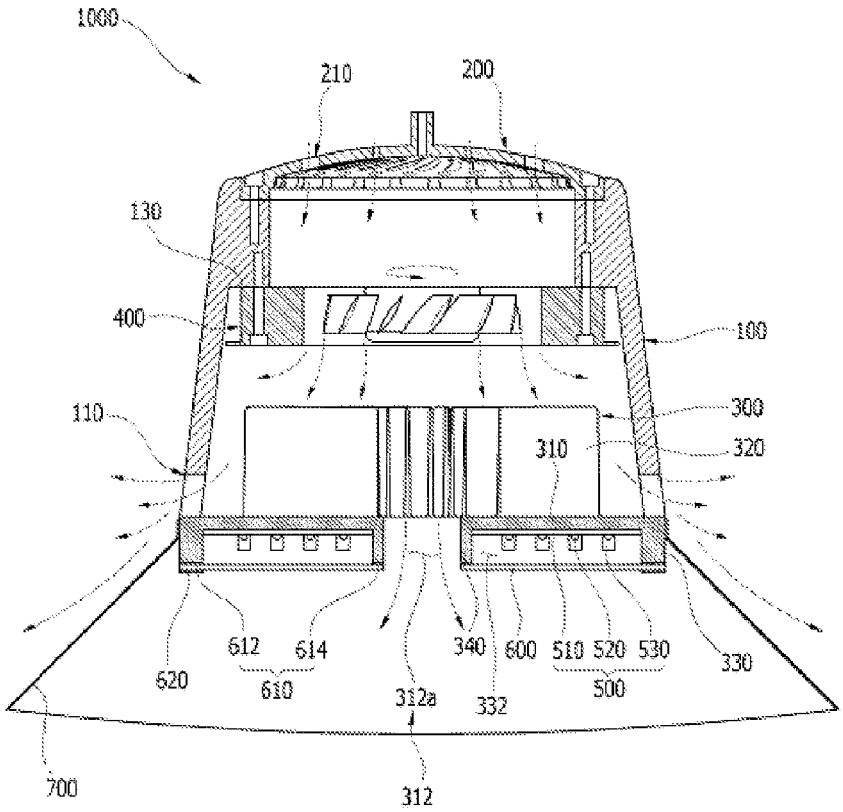
FIG. 3 is a cross sectional view illustrating one cross section of the optical semiconductor lighting fixture depicted in FIG. 1.

FIG. 1 is a perspective view illustrating an optical semiconductor lighting apparatus or fixture according to a first embodiment of the present invention. FIG. 2 is an exploded perspective view illustrating structural details of the optical semiconductor lighting apparatus of FIG. 1. FIG. 3 is a cross sectional view illustrating one cross section of the optical semiconductor lighting apparatus in FIG. 1.

Referring to FIGS. 1, 2 and 3, an optical semiconductor lighting apparatus 1000 according to the present embodiment includes a housing HS, a light source module 500, a fan 400 and a reflector 700.

The housing HS having a first end and a second end is open at the second end. The light source module 500 includes at least one optical semiconductor element 520. The fan 400 is in the housing HS and disposed adjacent to the light source module 500. The fan 400 sends air in to the light source module 500. The reflector 700 reflects light generated from the light source module 500 and enhances an illumination scope of the fixture. A moving path, in which at least a portion of the air drawn into the housing by the fan 400 externally flows through the light source module 500 and may be formed in the housing HS. The moving ambient air path will be described in detail later.

In addition, the lower portion of the housing HS may be apart from at least a portion of the outer side face of the reflector 700, so that at least a portion of the air drawn into the fixture by the fan 400 flows out to an outer side face of the reflector 700 (note air flow arrows in FIG. 3).

More particularly, an optical semiconductor lighting apparatus 1000 according to the present embodiment includes a housing HS, a heat sink 300, a fan 400, a light source module 500, a light diffusion plate 600, a sealing member 610, a plate fixing unit 620 and a reflector 700.

The housing HS has an inner space receiving the fan 400, etc. The lower portion of the housing HS is open, and an ambient air inlet 210 through which ambient air moves to an inner space of the fixture is formed at an upper end of housing HS.

For example, the housing HS may include a case body 100 having an inner space formed therein and an upper ambient air inlet cover 200 coupled to the case body 100. An upper portion and a lower portion of the case body 100 are open, and the upper cover 200 is coupled to the case body 100 to cover the upper portion of the case body 100. The case body 100 may have a cylindrical shape as shown in FIG. 1, and alternatively, may have a polygonal prism shape such as a quadrangular prism, a hexagonal prism, etc. The case body 100 and the upper cover 200 may be fashioned from a synthetic resin or metallic material, for example, an aluminum alloy.

The upper cover 200 includes an air inlet pattern of apertures 210 through which outer ambient cooling and cleaning air is drawn into the fixture. The air inlet apertures 210 may include first elongate and accurate inflow holes 212 extending from a central portion of the upper cover 200, and a second set of inflow holes 214 having a shape of a circle or a polygon. The first and second inflow holes 212 and 214 may be disposed peripherally offset from each other from a central position of the upper cover 200. In addition, the first and second inflow holes 212 and 214 may be formed in an accurate spiral shape corresponding to desired rotation of the underlying fan 400.

An outer air passageway or vent 110 is formed at the lower portion of the case body 100 to move air existing in the inner space to the outer side face of the reflector 700. The case body 100 has a plurality of lower support portions 120 downwardly protruding and peripherally spaced apart from each other, and as a result, the outer vent 110 may be separated into a plurality of peripheral openings by the lower support portions 120.

The heat sink 300 is disposed on a lower portion of the case body 100 and is coupled to the case body 100. For example, the heat sink 300 may be coupled to and fixed to the lower support portions 120 of the case body 100. The heat sink 300 may include material capable of absorbing and externally dissipating heat generated from the light source module 500. An exemplary example of heat sink material includes a metal alloy such as aluminum or magnesium. In addition, the heat sink 300 may have a structure capable of externally dissipating heat absorbed from the light source module 500. Particularly, the heat sink 300 may include a base plate 310, a plurality of heat dissipation protrusions or fins 320, a peripheral lower sidewall 330 and a middle protrusion wall 340.

The base plate 310 is disposed to cover the lower portion of the case body 100 and is operably coupled to the case body 100, and is designed to directly receive heat from the light source module 500. The edge portion of the base plate 310 may be coupled to and fixed to the lower support portions 120 of the case body 100. The base plate 310 has a heat sink aperture or vent 312 moving air from within an inner space of the LED light fixture. The heat sink vent 312 may include a middle vent 312*a* formed through a central portion of the base plate 310.

The heat dissipation protrusions or fins 320 are formed on an upper face of the base plate 310 facing the case body 100 and are disposed in the light fixture inner space to receive heat from the base plate 310 and externally dissipate the received heat. The heat dissipation protrusions 320 may have various structures and configurations having great heat dissipation efficiency, and for example, may have a structure and a configuration corresponding to the first and second inflow holes 212 and 214 of the upper cover 200. Particularly, the heat dissipation protrusions 320 may be disposed apart from each other and have a radial shape and a spiral shape based on the center of the base plate 310, corresponding to the first and second inflow holes 212 and 214. In other words, the heat dissipation protrusions 320 may be disposed apart from each other and have a radial shape and a spiral shape corresponding to a rotation direction of the fan 400 based on the middle vent 312*a*.

The peripheral lower sidewall 330 protrudes from a lower face of the base plate 310 on which the heat dissipation protrusions 320 are formed, and is disposed along the edge of the lower face of the base plate 310. As a result, a light source receiving space 332 is formed under the base plate 310 by the peripheral lower sidewall 330 to receive the light source module 500. The middle protrusion wall 340 protrudes from the lower face of the base plate 330, and creates a central vent 312*a* of the LED light fixture. An additional heat dissipation portion beside the heat sink 300 may be disposed inside and/or outside the housing HS. For example, the additional heat dissipation portion may be added to the heat sink 300, or include at least one of a heat pipe and a heat spreading member.

The fan 400 is disposed in the inner space of the case body 100. The fan 400 draws relatively cool ambient air through the air inlet 210 and directs the cooling air toward the heat sink 300. The cool air absorbs heat internally flowing from the heat sink 300, and concomitantly blows air downstream of the heat sink over the light source module 500 to prevent dust or foreign substances moving along with ascending air current from being deposited on the light source module 500 and the reflector 700. Thus, dust, air entrained particulates and foreign substances which might otherwise be deposited on the light source module 500 and/or the reflection face of the reflector 700 are removed to enhance light utilization efficiency. Moreover dust and foreign substances that tend to be deposited on the upper face of the reflector 700 are removed to enhance heat dissipation efficiency of the reflector 700.

The fan 400 includes a fan case that is open at upper and lower portions, a central axis disposed in the middle of the fan case, and a plurality of rotor blades disposed in the fan case to rotate on the central axis and a fractional horsepower motor. The central axis of the fan coincides with the center of the heat sink 300 and the center of the upper cover 200. A peripheral fan installation portion 130 may be formed at the inner side face of the case body 100 to couple the fan case to the light fixture housing 100. The fan installation portion 130 corresponds to a stepped portion at the inner side face of the case body 100 and is coupled to the edge of the fan case, as shown in FIG. 3. Alternatively, the fan installation portion 130 may correspond to a support protrusion portion (not shown) that protrudes from the inner side face of the case body 100 to support an edge of the fan case and be coupled to the fan case.

The light source module 500 is received in the light source receiving space 332, which is formed under the base plate 310 by the peripheral sidewall 330. The light source module 500 is disposed adjacent to a lower face of the base plate 310, to generate light in a downward looking direction with respect to the base plate 310.

The light source module 500 includes at least one optical semiconductor element 520 capable of generating light. For example, the optical semiconductor element 520 may include at least one of a light emitting diode (LED), an organic light emitting diode (OLED) and an electro-luminescence element (EL). Particularly, for example, the light source module 500 may further include a printed circuit board (PCB) 510 and optical cover units 530, in addition to the optical semiconductor elements 520.

The PCB 510 is disposed adjacent to the lower face of the base plate 310. A light source vent 512 is formed through the PCB 510 to correspond to the heat sink vent 312 formed through the base plate 310. The light source vent 512 includes a board middle vent 512*a* formed in the middle of the PCB 510 to correspond to the middle vent 312*a*, and the PCB 510 may make contact with the lower face of the base plate 310, with the middle protrusion wall 340 being inserted into the board middle vent 512*a*.

The optical semiconductor elements 520 are disposed apart from each other on the lower face of the PCB 510, and generate light by driving voltage provided from the PCB 510. Each of the optical semiconductor elements 520 may include at least one LED generating light, and the LED is capable of generating light having various wavelengths according to the use thereof, for example, red, yellow, blue, ultraviolet, etc.

The optical cover units 530 cover each of the optical semiconductor elements 520 to enhance optical characteristics of the light generated from each of the optical semiconductor elements 520, for example, optical luminance uniformity. For example, the optical cover units 530 may cover and protect each of the optical semiconductor elements 520, and diffuse the light generated from each of the optical semiconductor elements 520.

The diffusion plate 600 is disposed under and apart from the PCB 510 to diffuse the light generated from the optical semiconductor elements 520. Particularly, the diffusion plate 600 is disposed on the lower faces of the peripheral lower sidewall 330 and the middle protrusion wall 340 to cover the light source receiving space 332. A plate vent 602 is formed through the diffusion plate 600 to correspond to the light source vent 512 formed through the PCB 510. The plate vent 602 includes a plate middle vent 602*a* formed in the middle of the diffusion plate 600 to correspond to the board middle vent 512*a*. The diffusion plate 600 may include, for example, polymethyl methacrylate (PMMA) resin or polycarbonate (PC) resin.

The sealing member 610 is disposed between the diffusion plate 600 and the peripheral lower sidewall 330 or between the diffusion plate 600 and the middle protrusion wall 340, to prevent external moisture, foreign substance, etc. from entering the light source module 500. Particularly, the sealing member 610 may include a peripheral sealing ring 612 disposed between the diffusion plate 600 and the peripheral lower sidewall 330, and a middle sealing ring 614 disposed between the diffusion plate 600 and the middle protrusion wall 340. The peripheral sealing ring 612 and the middle sealing ring 614 are fashioned, for example, as relatively large diameter rubber O-rings.

The plate fixing unit 620 is disposed beneath the diffusion plate 600 along the edge of the diffusion plate 600, and the diffusion plate 600 is fixed to the peripheral lower sidewall 330 through a plurality of coupling screws (not shown). Thus, according as each of the coupling screws is coupled to the peripheral lower sidewall 330 through the plate fixing unit 620 and the diffusion plate 600, the edge portion of the diffusion plate 600 is tightly fixed to the peripheral lower sidewall 330. The middle portion of the diffusion plate 600 is also tightly fixed to the middle protrusion wall 340 by additional coupling screws. Thus, as the additional coupling screws are coupled to the middle protrusion wall 340 through the diffusion plate 600, the middle portion of the diffusion plate 600 is tightly fixed to the middle protrusion wall 340.

The reflector 700 is fashioned in the configuration of a hollow truncated cone and is disposed under the case body 100 to reflect the light that is generated by the light source module 500 and then diffused by the diffusion plate 600, and define an illumination scope or direction of the light. The reflector 700 may be coupled to and fixed to the outer peripheral face of the heat sink 300 by attachment to the side face of the base plate 310. The reflector 700 may include metallic material, for example, an aluminum alloy to absorb and externally dissipate heat generated from the light source module 500.

A dustproof film (not shown) may be formed on the surface of the reflector 700 to prevent dust, air entrained particulates, other foreign substances, etc. from sticking to the reflector 700. For example, the dustproof film may include a pollution-proof coating film such as a nano-green coating film. In addition, a plurality of embossed shapes having augmented surface areas may be formed on the surface of the reflector 700 to effectively dissipate the heat absorbed from the light source module 500.

Referring again to FIG. 3, air flow will be described when the fan 400 rotates in a forward direction.

First, the air flowing in the inner space through the air inlet 210 of the upper cover 200 is blown over the heat sink 300 by the fan 400. Concomitantly the heat sink 300 is absorbing heat generated from the light source module 500, and the relatively cool ambient air blown over the heat sink 300 absorbs heat from the heat sink 300 to reduce the temperature of the heat sink 300.

Some of the air blown over the heat sink 300 by the fan 400 is directed to the outer side face of the reflector 700 through the outer vent 110 formed at the lower end of the case body 100. This air flow from the outer vent 110 operable removes dust, air entrained particulates and foreign substances that may have accumulated on the fixture and prevents sticking or accumulation of further dust on the outer side face of the reflector 700. In addition heat is dissipated by the ambient air flow over the exterior surface of the reflector 700.

A moving ambient air path is formed within the housing HS to move the ambient air through the heat sink 300 by the fan 400, and the central air path is formed through the heat sink vent 312, the light source vent 512 and the light diffusion plate vent 602. Thus, cooling ambient air is directed centrally through the heat sink and the light source module 500 and downwardly from an interior surface of the reflector 700 to cool and at the same time prevent dust from sticking to the light source module 500 and the reflector 700.

Figure 4:
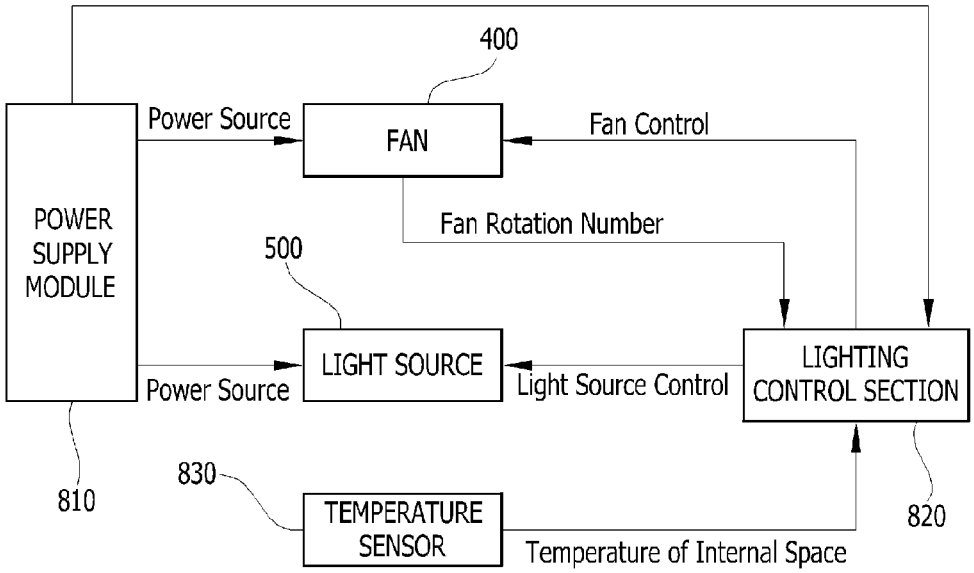
FIG. 4 is a block diagram illustrating operation of the optical semiconductor lighting apparatus in FIG. 1.

FIG. 4 is a block diagram illustrating operation of the optical semiconductor lighting apparatus in FIGS. 1-3.

Referring to FIGS. 3 and 4, the optical semiconductor lighting apparatus 1000 may further include a power supply module 810, a lighting control section 820 and a temperature sensor 830.

The power supply module 810 provides the fan 400 and the light source module 500 with a power source. Although not shown in the figures, the power supply module 810 may provide the lighting control section 820 and the temperature sensor 830 with a power source. The power supply module 810 may be disposed inside or outside the housing HS, and in the case that the power supply module 810 is disposed inside the housing HS, the power supply module 810 preferably disposed in a space between the upper cover 200 and the fan 400.

The lighting control section 820 may be electrically connected to the fan 400 and the light source module 500 to control the fan 400 and the light source module 500. The lighting control section 820 may be disposed on the lower face of the PCB 510, which is the same as the optical semiconductor elements 520, and alternatively may be disposed inside or outside the housing HS.

If the fan 400 is determined to be in a failure condition from the ground or the fan 400 is not operating well in spite of providing power to the fan 400, the lighting control section 820 operably controls the light source module 500 to generate selected colored light, for example, red light for indicating a breakdown condition of the fan 400. Alternatively the control may operate the optical semiconductor elements 520 of the light source module 500 to produce a flicker. For example, the lighting control section 820 receives information of fan rotation from the fan 400, and may determine the fan 400 to be approaching or in a failure mode when the fan 400 does not rotate or rotates at a speed less than a threshold value. A worker judges whether the fan 400 has failed or not through an illumination color of the lighting apparatus 1000. In this manner an operator is signaled to fix, repair or replace the lighting apparatus 1000.

The lighting control section 820 may control the fan 400 to rotate in a reverse direction for a selected time, for example, ten minutes every six hours so as to remove dust, air entrained particulates, foreign substances and the like which may have accumulated on the air inlet 210 of the upper cover 200.

The temperature sensor 830 is disposed in an inner space of the housing HS to sense temperature of the interior space. The lighting control section 820 may control rotation speed of the fan 400 according to a temperature provided by the temperature sensor 830. In other words, the rotation speed of the fan 400 can be operably increased when the temperature sensed by the temperature sensor 830 is higher than a threshold temperature. Moreover, the rotation speed of the fan 400 can be reduced when the temperature sensed by the temperature sensor 830 is lower than the threshold temperature.

In addition, a dust measuring unit (not shown) is further operably disposed within the housing HS to provide an indication of the amount of the dusts in the housing HS in real-time or intermittently to the lighting control section 820, and the lighting control section 820 is operable to control the rotation speed of the fan 400 according to the amount of dust and other foreign substances measured by the dust measuring unit (not shown).

According to the embodiment described above, the air moved by the fan 400 primarily absorbs the heat from the heat sink 300 and cools the heat sink 300. Some of the air is provided to an outer side face of the reflector 700 through the outer vent 110 to remove dust sticking to the outer side face of the reflector 700, and some of the air is provided under the light source module 500 through the heat sink vent 312, the light source vent 512 and the plate vent 602, to downwardly move dust from a lower portion of the lighting apparatus 1000 to the light source module 500. The fan 400 automatically rotates in a reverse direction every selected period of time, to remove dust and other foreign substances adhering to the surfaces surrounding the air inlet 210.

As described above, the optical semiconductor lighting apparatus 1000 of the present invention has an automatic clear function to prevent the lighting apparatus 1000 from breakdown or a decline of luminous efficiency and heat dissipation efficiency by an accumulation of dust, air entrained particulates and other foreign substances. The invention reduces maintenance costs by decreasing maintenance time, and preventing a decline of reflection efficiency and heat dissipation efficiency of the reflector by the dust and other foreign substances accumulation.

In addition, a worker easily determine breakdown of the fan 400 through color of the light generated from the lighting apparatus 1000, to fix, repair and exchange the fan 400 quickly. Further, temperature in the inner space of the housing HS may be measured in real-time, and the rotation speed of the fan 400 is determined according to the measured temperature, thereby efficiently removing the heat generated by the light source module 500.

Embodiment 2

Figure 5:
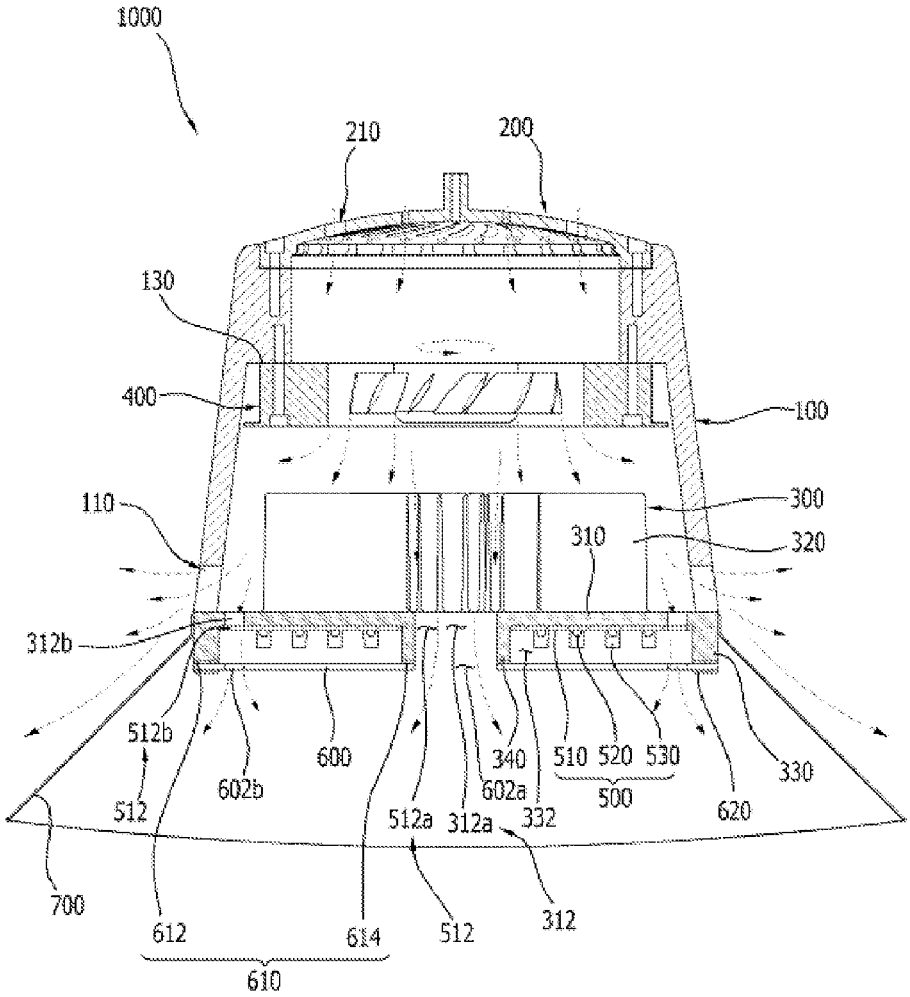
FIG. 5 is a cross sectional view illustrating an optical semiconductor lighting apparatus according to a second embodiment of the present invention.

FIG. 5 is a cross sectional view illustrating an optical semiconductor lighting apparatus according to a second embodiment of the present invention.

An optical semiconductor lighting apparatus 1000 shown in FIG. 5 is substantially the same as the lighting apparatus 1000 of Embodiment 1 described in FIGS. 1 to 4 except for a portion of the base plate 310, the PCB 510, and the diffusion plate 600. Thus, any further description for substantially the same elements as Embodiment 1 will be omitted, and the same reference numerals as Embodiment 1 will be given to substantially the same elements.

Referring to FIGS. 2 and 5, the base plate 310 of the heat sink 300 has a heat sink vent 312 to permit a portion of the air blown by the fan 400 to a position located under the reflector 700.

The heat sink vent 312 includes a middle vent 312*a* formed at the middle of the base plate 310 and a plurality of peripheral vents 312*b* formed at the edge of the base plate 310. The peripheral vents 312*b* may be formed apart from each other along the edge of the base plate 310. A light source vent 512 is formed through the PCB 510 of the light source module 500 at a location corresponding to the heat sink vent 312, and a plate vent 602 is formed through the diffusion plate 600 at a location corresponding to the light source vent 512. The light source vent 512 includes a board middle vent 512*a* formed at a location corresponding to the middle vent 312*a* and board peripheral vents 512*b* formed at locations corresponding to the peripheral vents 312*b*. The diffusion plate 600 includes a plate middle vent 602*a* at a location corresponding to the board middle vent 512*a* and a plate peripheral vent 602*b* at a location corresponding to the peripheral vents 512*b*.

According to the present embodiment, a portion of the air blown to the heat sink 300 by the fan 400 is provided to a location under the inner side surface of the reflector 700 through the peripheral vents 312*b* in addition to the middle vent 312*a*. In other words, a portion of the air provided to the heat sink 300 by the fan 400 passes through the peripheral vents 312*b*, the board peripheral vents 512*b* and the plate peripheral vents 602*b*, sequentially, and may be provided to the inner face surface of the reflector 700. The air provided to the inner side face of the reflector 700, as described above is operable to remove dust, air entrained particulates, foreign substances and the like adhering to the inner side face of the reflector 700.

Embodiment 3

Figure 6:
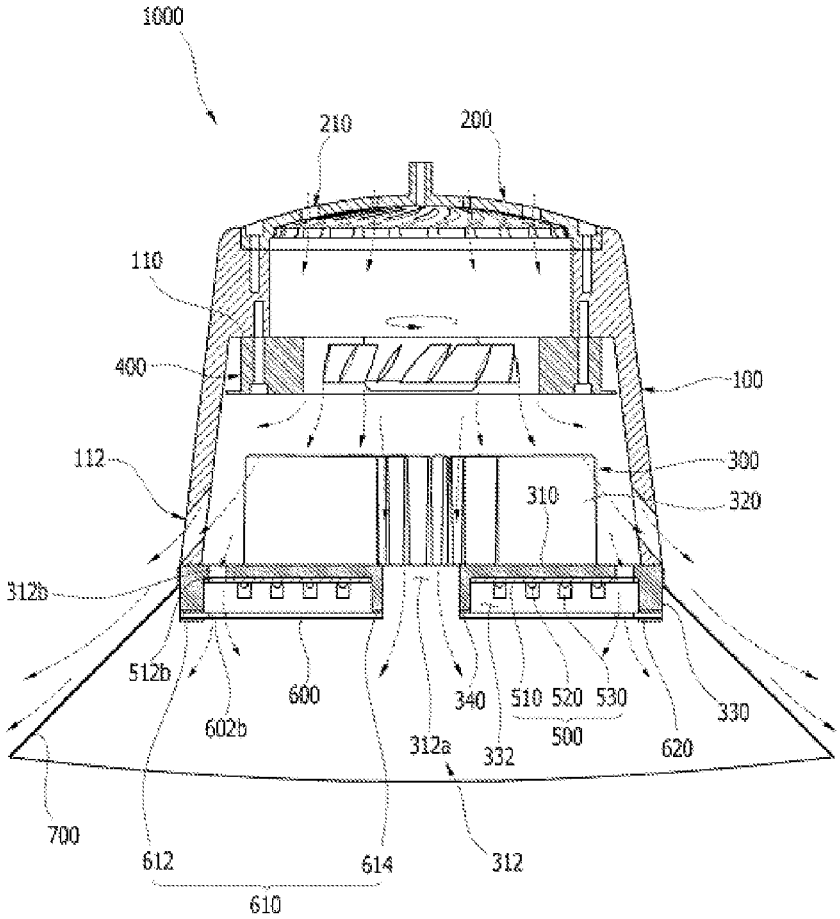
FIG. 6 is a cross sectional view illustrating an optical semiconductor lighting apparatus according to a third embodiment of the present invention.

FIG. 6 is a cross sectional view illustrating an optical semiconductor lighting apparatus according to a third embodiment of the present invention.

An optical semiconductor lighting apparatus 1000 shown in FIG. 6 is substantially the same as the lighting apparatus 1000 of the second embodiment described in association with FIG. 5 except for peripheral outlet apertures of the case body 100. Thus, any further description for substantially the same elements as the second embodiment will be omitted, and the same reference numerals as the second embodiment will be given to substantially the same elements.

Referring to FIGS. 2 and 6, an outer vent 112 is formed at the end portion of the case body 100 so that the air driven by the fan 400 moves to the outer side face of the reflector 700. The outer vent 112 has such a sloping shape with an imaginary central axis that forms an acute angle with respect to an imaginary central longitudinal axis of the housing 100. The imaginary central axis of the vents 112 is substantially parallel to the outer surface of the reflector 700 such that the air driven by the fan 400 is directly guided to and over the outer side face of the reflector 700. For example, the outer peripheral vent 112 may be formed at the end portion of the case body 100 with an inclined angle, corresponding substantially to the configuration of the outer side face of the reflector 700, as shown in FIG. 6. The inclined angle of the outer vent 112 may preferably be the same as or a little greater than the inclined angle of the reflector 700.

According to the present embodiment, the outer vent 112 has a shape that the air driven by the fan 400 is directly guided onto the outer side face of the reflector 700, and thus dust, air entrained debris and other foreign substances that may tend to accumulate on the outer side face of the reflector 700 is effectively removed and/or prevented from accumulating.

Embodiment 4

Figure 7:
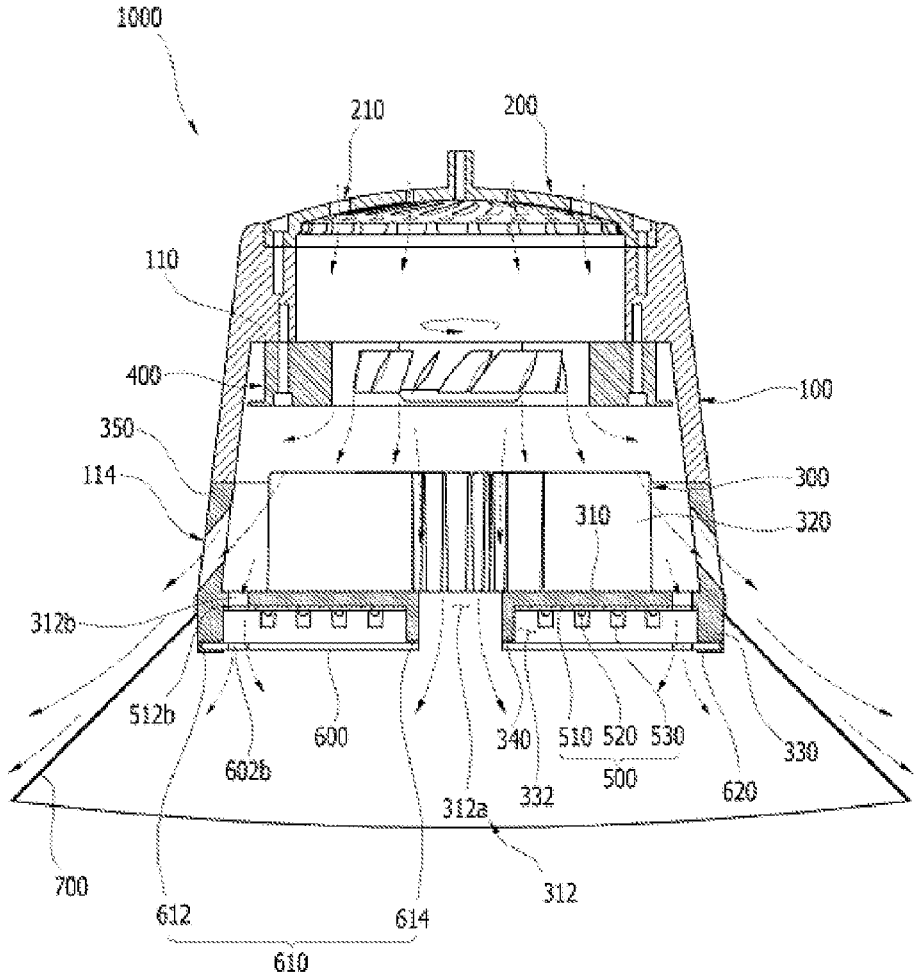
FIG. 7 is a cross sectional view illustrating an optical semiconductor lighting apparatus according to a fourth embodiment of the present invention.

FIG. 7 is a cross sectional view illustrating an optical semiconductor lighting apparatus according to a fourth embodiment of the present invention.

An optical semiconductor lighting apparatus 1000 shown in FIG. 7 is substantially the same as the lighting apparatus 1000 of the third embodiment described in FIG. 6 except for some of the heat sink 300 and the case body 100. Thus, any further description for substantially the same elements as the third embodiment will be omitted, and the same reference numerals as the third embodiment will be given to substantially the same elements.

Referring to FIGS. 2 and 7, an outer vent 114 through which the air driven by the fan 400 moves to the outer side face of the reflector 700 is formed at the edge portion of the heat sink 300 facing the outer side face of the reflector 700, which is different from in FIG. 6.

In addition, the heat sink 300 may further include a peripheral upper sidewall 350 protruding from the upper face of the base plate 310 toward the case body 100, and the outer peripheral vent 114 may be formed through the peripheral upper sidewall 350. The case body 100 may preferably be somewhat shorter than the case body 100 in FIG. 7 by a length, represented by a peripheral upper sidewall 350 protruding from an upper face of the base plate 310.

According to the present embodiment, the outer vent 114 is formed at the edge portion of the heat sink 300, not at the end portion of the case body 100, to direct the air moved by the fan 400 to the outer side face of the reflector 700.

Embodiment 5

Figure 8:
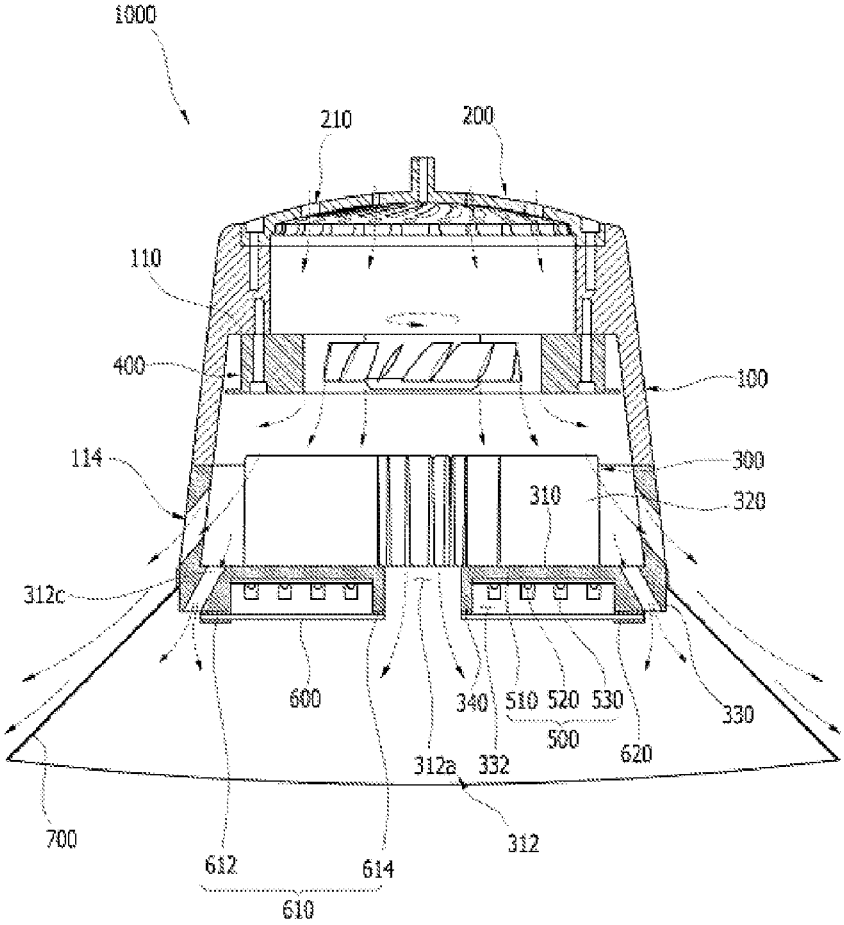
FIG. 8 is a cross sectional view illustrating an optical semiconductor lighting apparatus according to a fifth embodiment of the present invention.

FIG. 8 is a cross sectional view illustrating an optical semiconductor lighting apparatus according to a fifth embodiment of the present invention.

An optical semiconductor lighting apparatus 1000 shown in FIG. 8 is substantially the same as the lighting apparatus 1000 of Embodiment 4 described in FIG. 7 except for a portion of the heat sink 300, the PCB 510, and the diffusion plate 600. Thus, any further description for substantially the same elements as the fourth embodiment will be omitted, and the same reference numerals as the fourth embodiment will be given to substantially the same elements.

Referring to FIGS. 2 and 7, a plurality of peripheral vents 312*c* are formed at an edge portion of the heat sink 300 and are peripherally spaced apart from each other to directly deposit a portion of the air moved by the fan 400 onto the inner side face of the reflector 700 Each of the edge vents 312*c* is formed through the base plate 310 and the peripheral lower sidewall 330, and may have such a shape that the air driven by the fan 400 is directly guided to the inner side face of the reflector 700. For example, the edge vents 312*c* may be formed at the base plate 310 and the peripheral lower sidewall 330 with an inclined angle corresponding to the configuration of the inner side face of the reflector 700, as shown in FIG. 8. The inclined angle of the edge vents 312*c* is preferably the same as or a little smaller than the inclined angle of the reflector 700.

In the present embodiment, the board peripheral vents 512*b* and the plate peripheral vents 602*b* in FIG. 7 are not formed through the PCB 510 and the diffusion plate 600, respectively. In addition, the diffusion plate 600 is disposed on the peripheral lower sidewall 330 so as not to cover the edge vents 312*c*.

According to the present embodiment, the edge vents 312*c* in addition to the outer vents 114 are formed at the edge portions of the heat sink 300, and thus dusts, air entrained particulates, and other foreign substances that may tend to accumulate on the outer side face and the inner side face of the reflector 700 is removed by air flowing through the heat sink 300.

According to the present embodiment, the outer vent 114 has a shape that the air driven by the fan 400 is directly guided onto the outer side face of the reflector 700, and thus dust air entrained debris and other foreign substances that may tend to accumulate on the outer side face of the reflector 700 is effectively prevented from accumulating.

Embodiment 6

Figure 9:
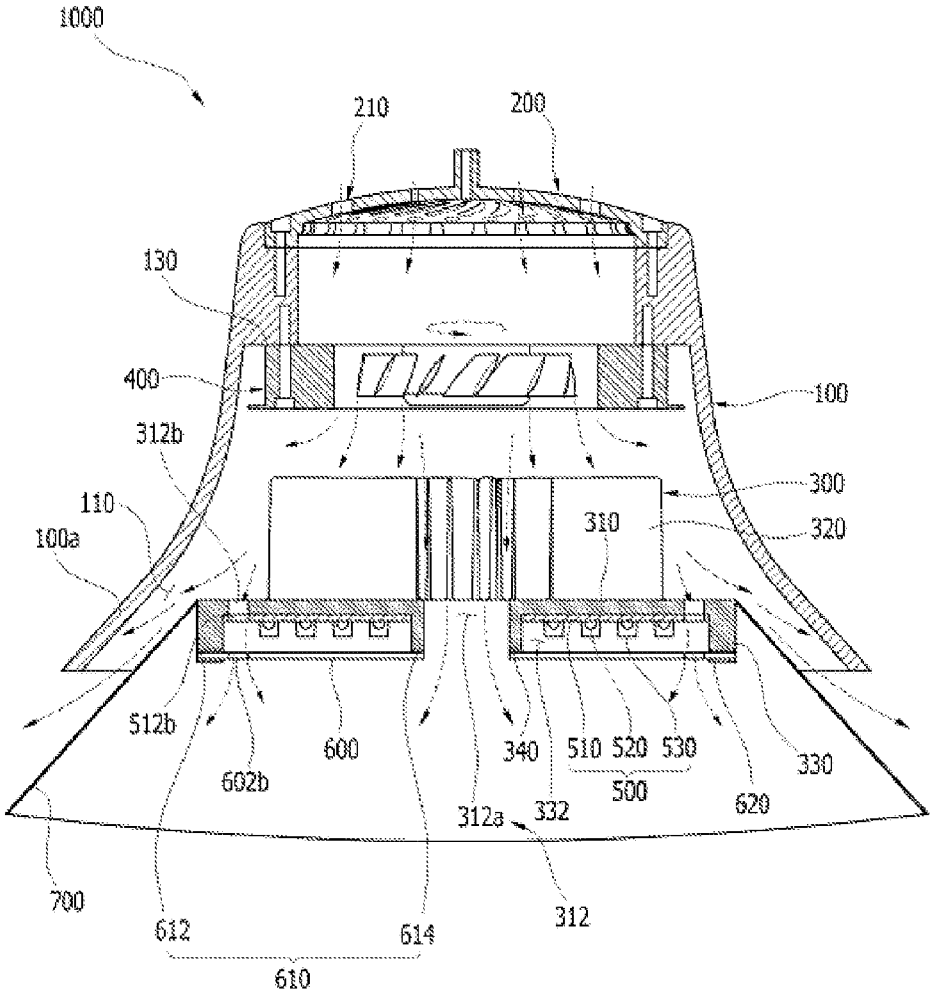
FIG. 9 is a cross sectional view illustrating an optical semiconductor lighting apparatus according to a sixth embodiment of the present invention.

FIG. 9 is a cross sectional view illustrating an optical semiconductor lighting apparatus according to a sixth embodiment of the present invention.

An optical semiconductor lighting apparatus 1000 shown in FIG. 9 is substantially the same as the lighting apparatus 1000 of the second embodiment described in connection with FIG. 5 except for a portion of the case body 100, the base plate 310 of the heat sink 300, the PCB 510 of the light source module 500, the diffusion plate 600, and the reflector 700. Thus, any further description for substantially the same elements as the second embodiment will be omitted, and the same reference numerals as the second embodiment will be given to substantially the same elements.

Referring to FIGS. 2 and 9, the lower end portion 100*a* of the case body 100 is flared outwardly with respect to the outer side face of the reflector 700 and overlaps with the outer side face of the reflector 700. The lower end portion 100*a* of the case body 100 covers ⅓ to ½ of the outer side face of the reflector 700 from the upper end thereof, and alternatively may cover the entire portion of the outer side face of the reflector 700. In addition, the lower end portion 100*a* of the case body 100 has an inclination substantially the same as or a little greater/smaller than the inclination of the outer side face of the reflector 700. An outer vent 110 is formed between the lower end portion 100*a* of the case body 100 and the reflector 700. The spatial relationship of the wall surface 100*a* with respect to reflector 700 is maintained by the provision of a plurality of spanner struts (not shown).

Referring again to FIG. 9, air flow will be described when the fan 400 rotates in a forward direction.

First, the air flowing in the inner space through the air inlet 210 of the upper cover 200 is blown to the heat sink 300 by the fan 400. At this time, the heat sink 300 absorbing the heat generated from the light source module 500 is hotter than ambient air and the air blown over and through the heat sink 300 is receive the heat from the heat sink 300 to reduce the temperature of the heat sink 300.

Some of the air blown to the heat sink 300 by the fan 400 is directed against the outer side face of the reflector 700 through the peripheral outer vent zone 110, to remove dusts, foreign substances, air entrained debris, etc. adhering to the outer side face of the reflector 700. Since the lower end portion 100*a* of the case body 100 is disposed apart from the outer side face of the reflector 700 to overlap the outer side face of the reflector 700 an outer vent 110 is formed. Some of the air blown over the heat sink 300 by the fan 400 is blown along the outer side face of the reflector 700 when flowing out through the outer vent 110. As a result, dust, air entrained particulates, other foreign substances tending to accumulate on the outer side face of the reflector 700 may be effectively removed and/or prevented from accumulating in the first instance.

In addition, the upper end of the reflector 700 is disposed coincident with the upper end of the side face of the base plate 310 of the heat sink 300, and thus air flowing out through the outer vent 110 is directed over the outer side face of the reflector 700. As a result, dust, air entrained debris, and other foreign substances accumulated on an upper end portion of the outer side face of the reflector 700 may be effectively removed and/or prevented from accumulating.

A central moving air path is also formed in the housing HS to move the air blown to and through the heat sink 300 under the light source module 500 by the fan 400. The air moving path includes a first moving path formed by the middle vent 312*a*, the board middle vent 512*a* and the plate middle vent 602*a*, and a second moving path formed by the peripheral vents 312*b*, the board peripheral vents 512*b* and the plate peripheral vents 602*b*.

Thus, the air, which blows through a central portion of the light source module 500 through the first moving path, downwardly directs air from the lower portion of the lighting apparatus 1000 to the light source module 500, to thereby prevent dust and other debris from sticking to the reflector 700. In addition, the air, which blows under the edge of the light source module 500 through the second path, may directly move the inner face of the reflector 700, to effectively removes any dust or debris adhering to the inner face of the reflector 700.

In the present embodiment, for example, a modified example of the second embodiment is illustrated, and alternatively, however, the present sixth embodiment may be applied to the other previous embodiments.

Embodiment 7

Figure 10:
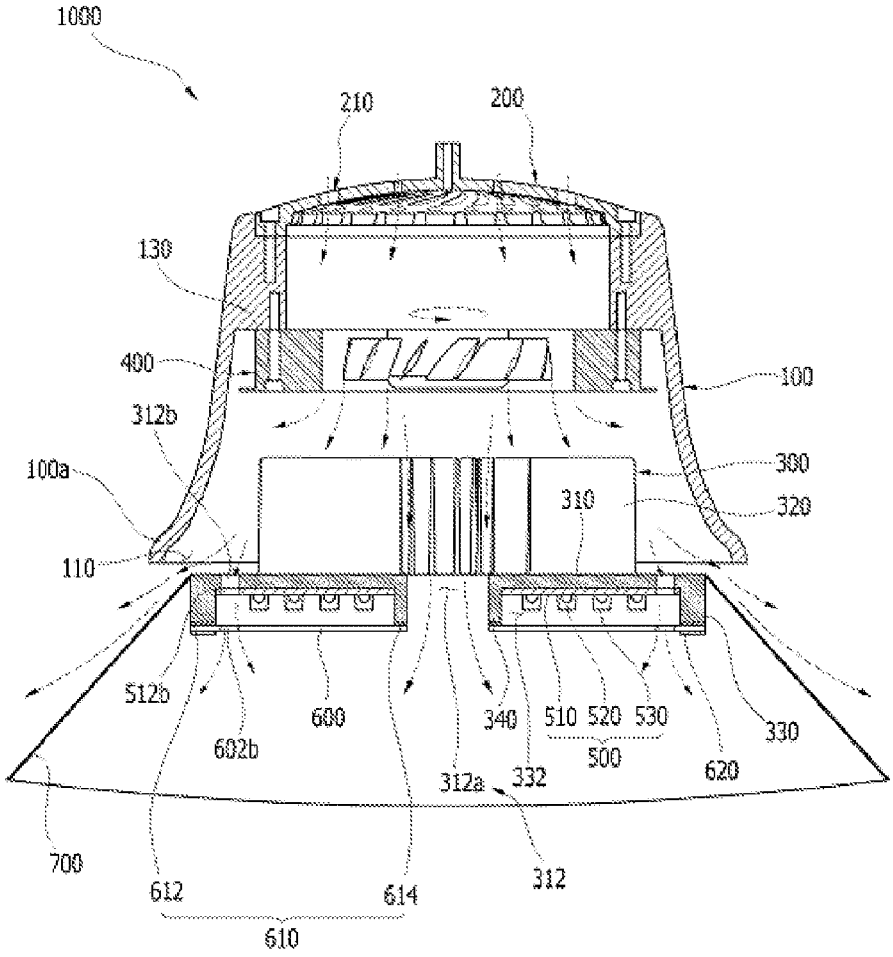
FIG. 10 is a cross sectional view illustrating an optical semiconductor lighting apparatus according to a seventh embodiment of the present invention.

FIG. 10 is a cross sectional view illustrating an optical semiconductor lighting apparatus according to a seventh embodiment of the present invention.

An optical semiconductor lighting apparatus 1000 shown in FIG. 10 is substantially the same as the lighting apparatus 1000 of the sixth embodiment described in FIG. 9 except for the lower end portion 100*a* of the case body 100. Thus, any further description for substantially the same elements as the sixth embodiment will be omitted, and the same reference numerals as the sixth embodiment will be given to substantially the same elements.

Referring to FIGS. 2 and 10, the lower end portion 100*a* of the case body 100 is modified to have such a shape that the air that is drawn in and then blown out by the fan 400 is concentrated on the outer side face of the reflector 700 and moved by strong pressure.

Particularly, for example, the lower end portion 100*a* of the housing 100 may have such a bell shape that a portion of the inner side facing the upper end of the reflector 700 overlaps a portion of the upper end of the reflector 700, i.e., a portion facing the edge portion of the heat sink 300 is concavely rounded. In other words, the lower portion of the housing, which overlaps with the reflector, protrudes outward. Thus, at the lower end portion 100*a* of the housing 100, the air that is drawn in and then blown out by the fan 400 is concentrated by the concavely rounded portion 100*a* and externally discharged by strong pressure.

Alternatively, the lower end portion 100*a* of the housing 100 may be modified to have a shape that the lower end portion 100*a* of the housing 100 overlaps at least a portion of the reflector 700 as shown in FIG. 9 and the interval between the lower end portion 100*a* of the housing 100 and the outer surface of the reflector 700 becomes narrower along the lower direction of the reflector 700. Thus, since the interval between the lower end portion 100*a* of the housing 100 and the outer surface of the reflector 700 becomes narrower along the lower direction of the reflector 700, the air that is drawn in and then blown out by the fan 400 is discharged by strong pressure and substantial air flow.

According to the present embodiment, a portion of the lower end portion 100*a* of the housing 100 has a modified shape to move the air having strong pressure and substantial air flow along the outer side face of the reflector 700, and thus dust and other debris that may tend to accumulate on the outer side face of the reflector 700 may be effectively removed by the strong air flow or preventing from accumulating on an exterior surface of the reflector 700.

In the present embodiment, for example, a modified example of Embodiment 6 is illustrated, and alternatively, the present embodiment may be applied to the other previous embodiments.

Embodiment 8

Figure 11:
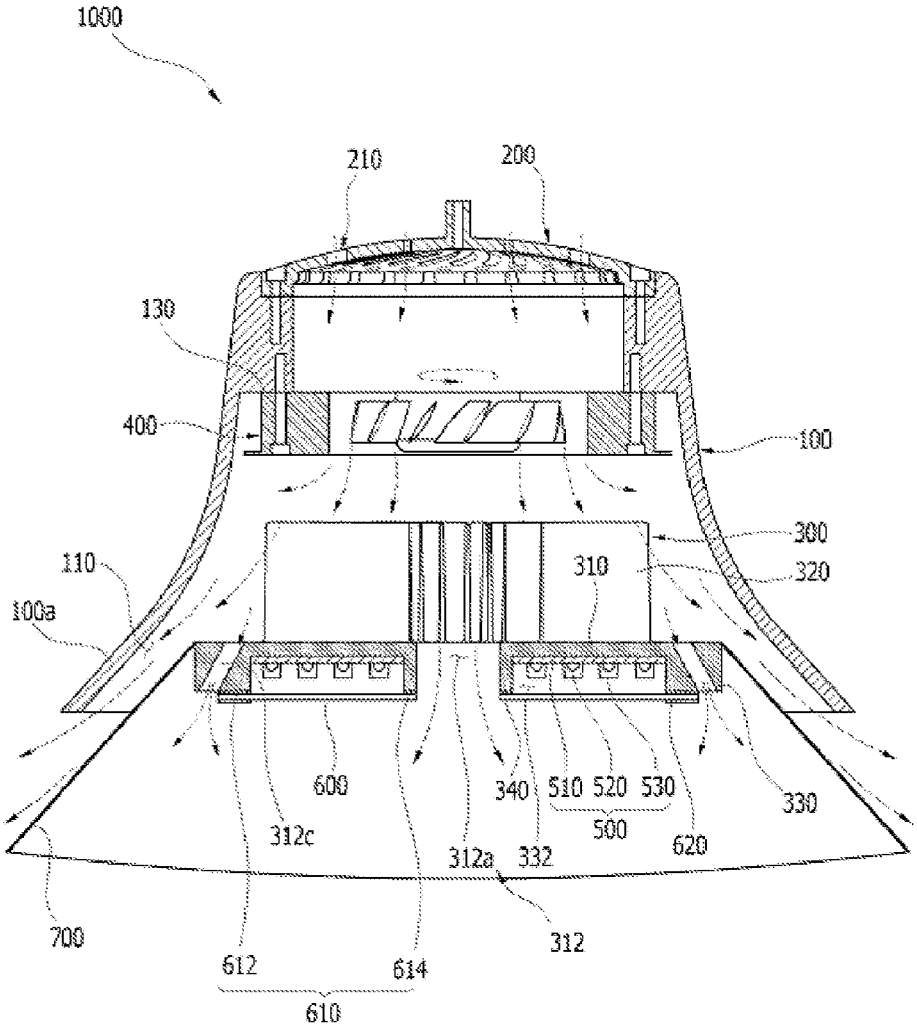
FIG. 11 is a cross sectional view illustrating an optical semiconductor lighting apparatus according to an eighth embodiment of the present invention.

FIG. 11 is a cross sectional view illustrating an optical semiconductor lighting apparatus according to an eighth embodiment of the present invention.

An optical semiconductor lighting apparatus 1000 shown in FIG. 11 is substantially the same as the lighting apparatus 1000 of the sixth embodiment described in FIG. 9 except for some portions of the heat sink 300, the PCB 510, and the diffusion plate 600. Thus, any further description for substantially the same elements as the sixth embodiment will be omitted, and the same reference numerals as the sixth embodiment will be given to substantially the same elements.

Referring to FIGS. 2 and 11, a plurality of edge vents 312*c* are formed at the edge portion of the heat sink 300 and are peripherally spaced apart from each other to directly move the air moved by the fan 400 to the inner side face of the reflector 700.

Particularly, each of the edge vents 312*c* is formed through the base plate 310 and the peripheral lower sidewall 330, and may have such a shape that the air blown by the fan 400 may be directly guided to the inner side face of the reflector 700. The edge vents 312*c* may be formed through the base plate 310 and the peripheral lower sidewall 330 with an inclined angle, corresponding to the configuration of the inner side face of the reflector 700, as shown in FIG. 11. The inclined angle of the edge vents 312*c* may preferably be the same as or a little smaller than the inclined angle of the reflector 700.

Although not shown in FIG. 11, the peripheral vent 312*b*, the board peripheral vents 512*b* and the plate peripheral vents 602*b* shown in FIG. 9 may also be formed in the eighth embodiment illustrated in FIG. 11. In addition, the diffusion plate 600 is disposed on the peripheral lower sidewall 330 in a manner that does not cover the edge vents 312*c*.

According to the present embodiment, the edge vents 312*c* are formed at the edge portion of the heat sink 300, and thus dust that may tend to accumulate on the inner side face of the reflector 700 is effectively removed or prevented from initial accumulation.

Modifications applied to the present embodiment may be applied to the other previous embodiments.

Embodiment 9

Figure 12:
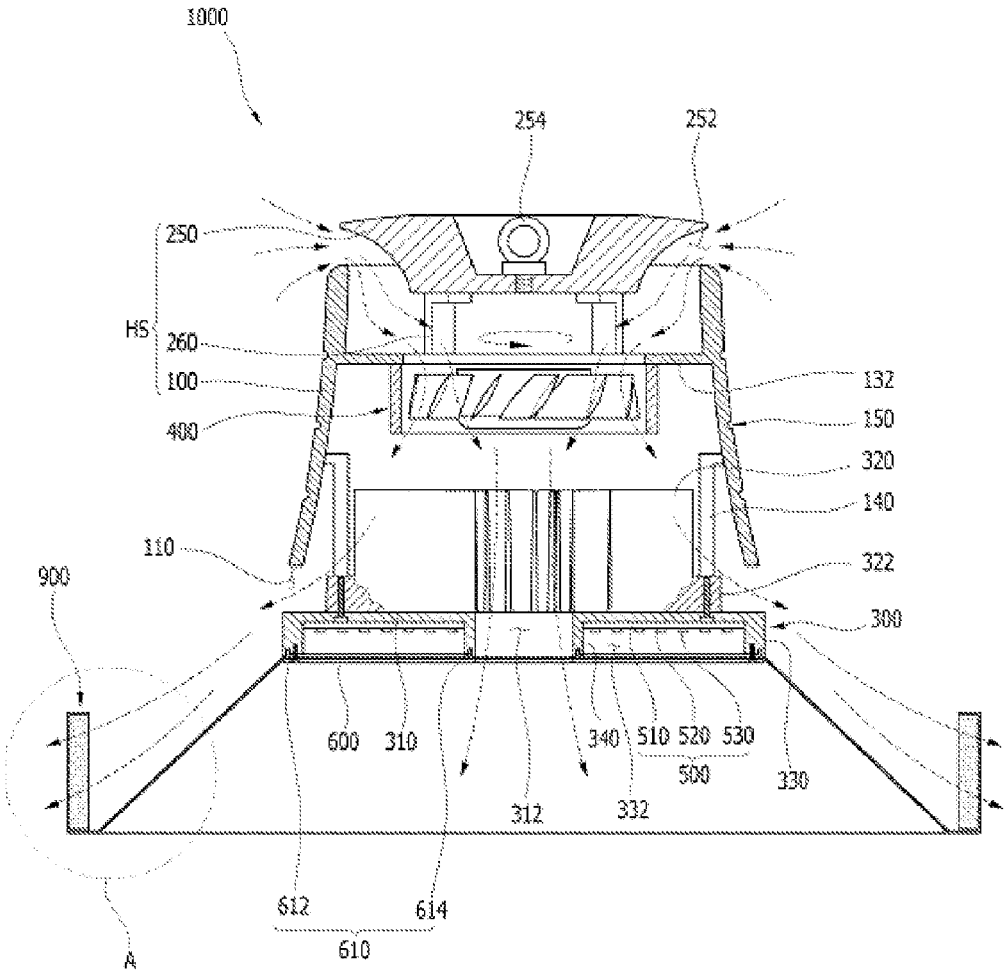
FIG. 12 is a cross sectional view illustrating an optical semiconductor lighting apparatus according to a ninth embodiment of the present invention.
Figure 13:
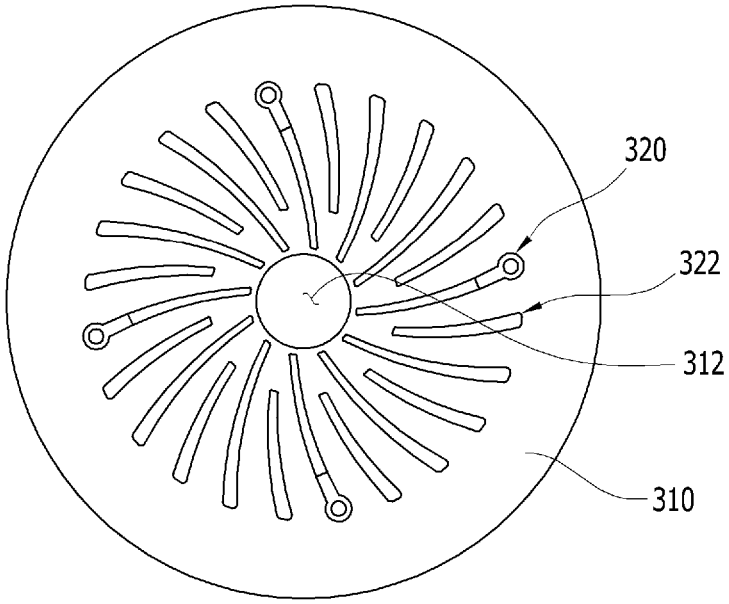
FIGS. 13 and 14 are plan views illustrating configurations of heat dissipation protrusions of a heat sink depicted in FIG. 12.
Figure 14:
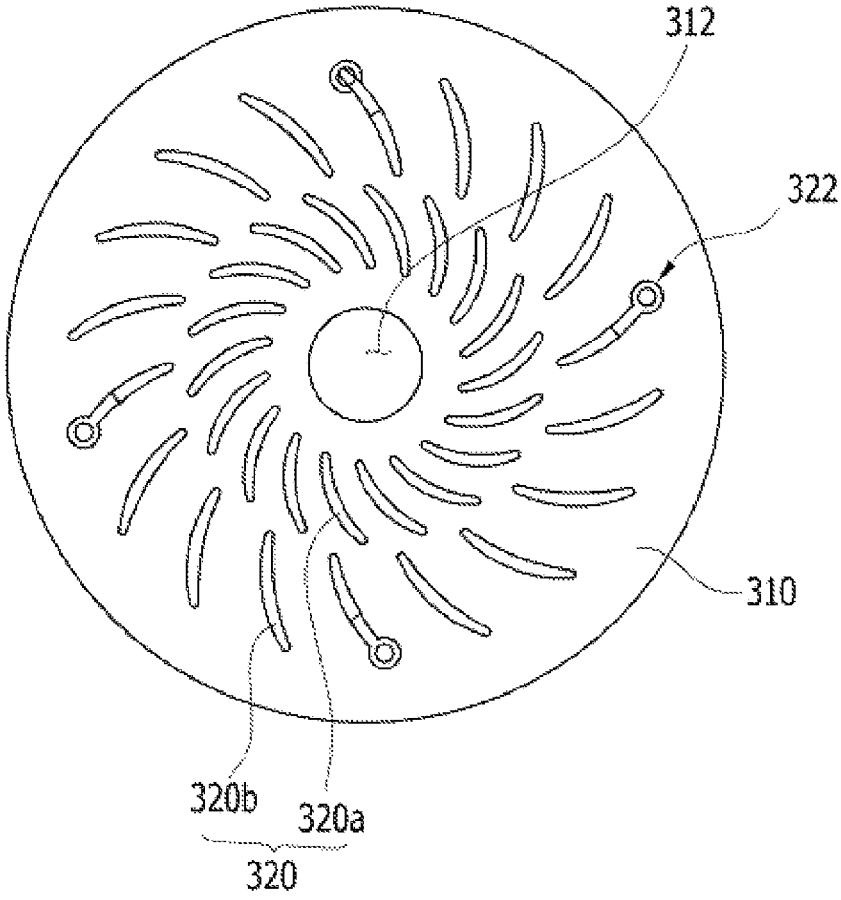
Figure 15:
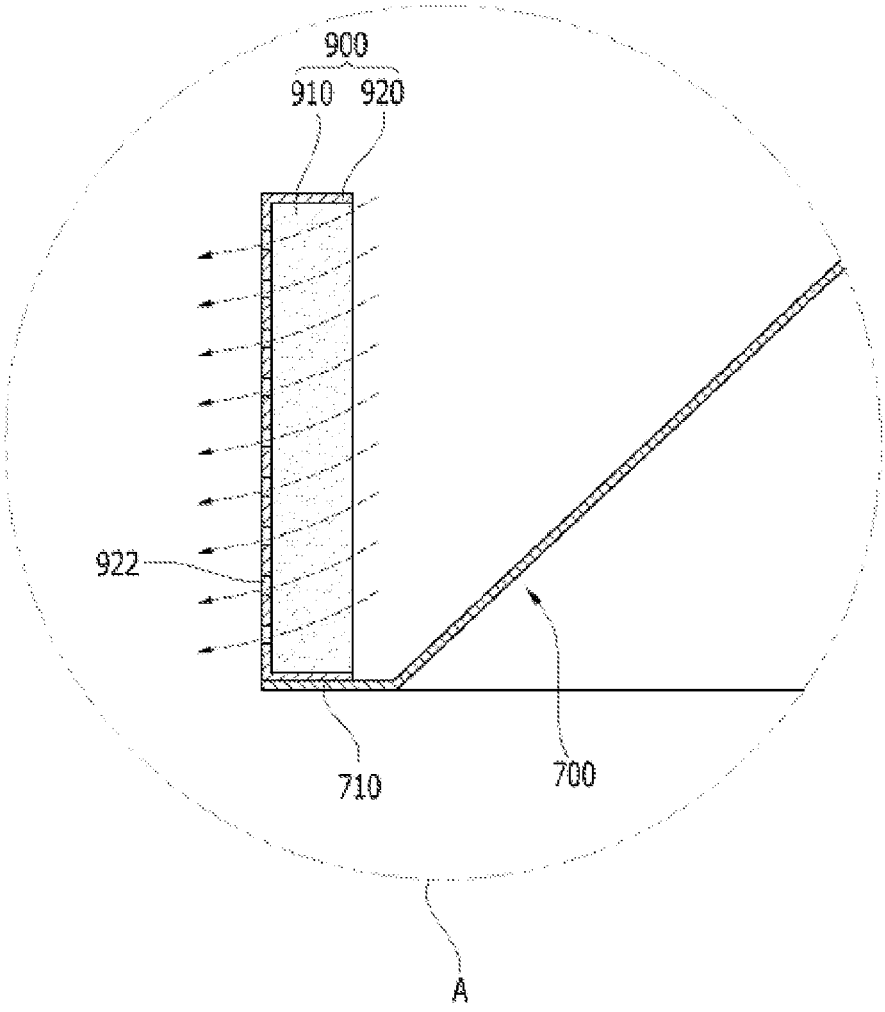
FIG. 15 is an enlarged cross sectional view of a filter portion 'A' in FIG. 12.

FIG. 12 is a cross sectional view illustrating an optical semiconductor lighting apparatus according to a ninth embodiment of the present invention. FIGS. 13 and 14 are plan views illustrating configurations of heat dissipation protrusions 320 of the heat sink 300 in FIG. 12. FIG. 15 is an enlarged cross sectional view of a portion 'A' in FIG. 12.

Referring to FIGS. 12 to 15, an optical semiconductor lighting apparatus 1000 according to the present embodiment includes a housing HS, a heat sink 300, a fan 400, a light source module 500, a diffusion plate 600, a sealing member, a plate fixing unit, a reflector 700 and a dust collecting module 900.

The housing HS may include a case body 100 having an inner space formed therein, an upper cover 250 is disposed over the case body 100 and at least one cover coupling portion 260 couples the upper cover 250 to the case body 100.

An upper portion and lower portion of the case body 100 are open, and the case body 100 receives the fan 400 as discussed above. The case body 100 may have a cylindrical shape or a polygonal cross section such as a quadrangular or hexagonal shape, etc. The case body 100 may be advantageously composed of a synthetic resin material.

A fan installation portion 132, which will be described later, is coupled to the fan 400 and a plurality of inner support portions 140, which will also be described later, are disposed to couple the heat sink 300 to an interior side face of the case body 100. In addition, vent 110 is formed at the lower end of the case body 100 to direct the air existing in the interior space to the outer side face of the reflector 700.

A plurality of peripheral grooves 150 are formed on the outer side face of the case body 100, and are spaced apart from each other at the upper and lower portions of the case body 100. A plurality of stripe protrusions (not shown) may be formed on the outer side face of the case body 100, instead of the stripe grooves 150. The stripe grooves 150 or the stripe protrusions are operable to increase the grip of the hands of a worker to prevent the lighting apparatus 1000 from being dropped or damaged in handling.

The upper cover 250 is disposed in a spaced position with respect to the upper end of the case body 100 and serves to cover an upper portion of the case body 100. As a result, a lateral or side inlet passage 252 is created through which ambient air can move into the case body 100. Since the side inlet 252 is formed between the upper cover 250 and the upper end of the case body 100, outer dust may be prevented from accumulating within the side inlet 252. More particularly, in previous embodiments, the air inlets 210 were formed in a posture being upwardly exposed and may be plugged up by descending dust and other foreign particulates, but in the present embodiment, the side inlet 252 formed by the upper cover 250 reduces the risk of the peripheral inlet 252 ever becoming plugged with dust and/or other foreign particulates.

An installation ring 254 may be formed on an upper face of the cover 250 for installing the lighting apparatus 1000 within a factory, or workplace and a predetermined groove may be formed around the installation ring 254. The upper cover 250 may be composed of a synthetic resin or metallic material, for example, an aluminum alloy.

The cover coupling portion 260 is disposed between the upper cover 250 and the case body 100 to fix the upper cover 250 to the case body 100. A plurality of cover coupling portions 260 are disposed in a peripherally spaced posture with respect to each other and between the lower face of the upper cover 250 and the upper face of the fan installation portion 132 formed at the case body 100. This coupling arrangement 260 operably fixes the upper cover 250 with respect to the case body 100. The cover coupling portions 260 may be separable from the upper cover 250 or the inner side face of the case body 100, as shown in the Figures or alternatively may be integrally formed with the upper cover 250 or the inner side face of the case body 100.

The heat sink 300 is disposed to cover the lower portion of the case body 100 and is coupled to the case body 100. For example, the heat sink 300 may be coupled to and fixed to the inner support portions 140 of the case body 100. The heat sink 300 may include material capable of absorbing and externally dissipating the heat generated from the light source module 500. For example, the heat sink 300 may be manufactured from a metal alloy including aluminum or magnesium. In addition, the heat sink 300 may have a structure capable of externally dissipating heat absorbed from the light source module 500. Particularly, the heat sink 300 may include a base plate 310, a plurality of upstanding heat dissipation protrusions or fins 320, a peripheral lower sidewall 330 and a middle protrusion wall 340.

The base plate 310 is disposed to cover the lower portion of the case body 100 and is coupled to the case body 100. The base plate 310 directly receives heat from the light source module 500. The base plate 310 may have a heat sink vent 312 moving air existing in the housing HS to a location beneath the heat sink 300, and the heat sink vent 312 may be formed at the center of the base plate 310.

The heat dissipation protrusions or fins 320 are formed on an upper face of the base plate 310 facing the case body 100 and are disposed in the housing HS to receive heat from the base plate 310 and externally dissipate the received heat. Some of the heat dissipation protrusions 320 may be coupled to the lower end of the inner support portions 140 formed at the inner side face of the case body 100 to fix the heat sink 300 to the case body 100. For example, the inner support portions 140 extends toward some of the heat dissipation protrusions 320, and stepped portions 322 may be formed at some of the heat dissipation protrusions 320 to be coupled to the inner support portions 140. The heat sink 300 may be coupled to the case body 100 by other means instead of the heat dissipation protrusions 320.

The heat dissipation protrusions 320 may have various structures and configurations that exhibit substantial heat dissipation efficiency. For example, the heat dissipation protrusions 320 may be disposed apart from each other and have an accurate radial shape and a spiral overall configuration extending outwardly from the center of the base plate 310. The heat dissipation protrusions 320 may be disposed in a peripherally spaced posture from each other and have an accurate radial shape and an overall spiral configuration to correspond to a rotational direction of the fan 400 as shown in FIG. 13.

Alternatively, the heat dissipation protrusions 320 may include a first tier of protrusion portions 320*a* and second tier of protrusion portions 320*b* as shown in FIG. 14. The first protrusion portions 320*a* are peripherally disposed apart from each other and have an accurate, radial shape and an overall spiral configuration extending from the heat sink vent 312. The second tier of protrusion portions 320*b* are peripherally disposed apart from each other and have an accurate radial shape and a spiral shape based on the heat sink vent 312. The second tier of protrusion portions 320*b* are radially disposed outwardly from and peripherally extend between the first protrusion portions 320*a*.

The peripheral lower sidewall 330 protrudes from a lower face of the base plate 310, on which the heat dissipation protrusions 320 are mounted, and is disposed along the edge of the lower face of the base plate 310. As a result, a light source receiving space 332 is formed under the base plate 310 by the peripheral lower sidewall 330 and is operable to receive the light source module 500. A middle protrusion wall 340 protrudes from the lower face of the base plate 330, and is centrally formed about an imaginary central longitudinal axis and extends along the edge of the heat sink vent 312. When the heat sink vent 312 has a circular shape as shown in the Figures similarly, the middle protrusion wall 340 will have a circular cylindrical shape. Alternatively other geometrical cylindrical wall configurations are envisioned.

The fan 400 is disposed in the interior space of the case body 100. The fan 400 draws outer air provided through the air inlet 252 to the heat sink 300 to cool heat internally flowing from the heat sink 300. The fan 400 may include a fan case that is open at upper and lower portions thereof, a central axis disposed in the middle of the fan case, and a plurality of rotor blades disposed in the fan case to rotate about the central axis. The central axis operably coincides with the center of the heat sink 300 and the center of the upper cover 250. The fan case is operably connected to the fan installation portion 132 formed at the inner side face of the case body 100.

The light source module 500 is received in the light source receiving space 332, which is formed under the base plate 310 by the peripheral lower sidewall 330, and disposed adjacent to the lower face of the base plate 310, to generate light in a lower direction with respect to the base plate 310. Particularly, the light source module 500 may include a PCB 510, a plurality of optical semiconductor elements 520 and optical cover units 530.

The PCB 510 is disposed adjacent to the lower face of the base plate 310. A light source vent is formed through the PCB 510 to correspond to the heat sink vent 312 formed through the base plate 310. The light source vent may be formed in the middle of the PCB 510 to correspond to the heat sink vent 312. The PCB 510 may be adjacent to the base plate 310, with the middle protrusion wall 340 being inserted into the light source vent.

The optical semiconductor elements 520 are generally uniformly spaces apart from each other on the lower face of the PCB 510, and generate light by driving voltage provided from the PCB 510. Each of the optical semiconductor elements 520 includes at least one LED generating light. The LED is capable of generating light having various wavelengths according to the use thereof, for example, red, yellow, blue, ultraviolet, etc.

The optical cover units 530 cover each of the optical semiconductor elements 520 to enhance optical characteristics of the light generated from each of the optical semiconductor elements 520 to produce optical luminance uniformity. For example, the optical cover units 530 may cover and protect each of the optical semiconductor elements 520, and diffuse the light generated from each of the optical semiconductor elements 520.

The diffusion plate 600 is disposed under and apart from the PCB 510 to diffuse the light generated from the optical semiconductor elements 520. Particularly, the diffusion plate 600 is disposed on the lower faces of the peripheral lower sidewall 330 and the middle protrusion wall 340 to cover the light source receiving space 332. A vent 602 is formed through the diffusion plate 600 to correspond to the light source vent 512 formed through the PCB 510. The vent 602 is formed in the middle of the diffusion plate 600 to correspond to the light source vent 512. The diffusion plate 600 may be composed of polymethylmethacrylate (PMMA) resin or polycarbonate (PC) resin.

The sealing member 610 is disposed between the diffusion plate 600 and the peripheral lower sidewall 330 and between the diffusion plate 600 and the middle protrusion wall 340, to prevent external moisture, foreign substance, etc. from entering the light source module 500. The sealing member 610 may include a peripheral sealing ring disposed between the diffusion plate 600 and the peripheral lower sidewall 330, and a middle sealing ring disposed between the diffusion plate 600 and the middle protrusion wall 340. The peripheral sealing ring and the middle sealing ring may correspond to, for example, a rubber O-ring.

The plate fixing unit is disposed beneath the diffusion plate 600 along the edge of the diffusion plate 600, and the diffusion plate 600 is fixed to the peripheral lower sidewall 330 through a plurality of coupling screws. As each of the coupling screws is coupled to the peripheral lower sidewall 330 through the plate fixing unit and the diffusion plate 600, the edge portion of the diffusion plate 600 may be tightly fixed to the peripheral lower sidewall 330.

The reflector 700 is disposed under the case body 100 to reflect light that is generated by the light source module 500 and then diffused by the diffusion plate 600, and define an illumination scope of the light. The reflector 700 is fixed to the side face of the heat sink 300, for example, the side face of the base plate 310. A dust collecting module support portion 710 may be formed at the lower end of the reflector 700 to support a dust collecting module 900.

The reflector 700 may include metallic material, for example, aluminum alloy to absorb and externally dissipate heat generated from the light source module 500. In addition, a dustproof film (not shown) may be formed on the surface of the reflector 700 to prevent dust, air entrained particulates, and other foreign substances from adhering to the reflector 700. For example, the dustproof film may include a pollution-proof coating film such as a nano-green coating film.

The dust collecting module 900 is disposed above the outer side face of the reflector 700 to correspond to the outer vent 110, and filters and collects dusts included in air. The dust collecting module 900 may be disposed on and fixed to the dust collecting module support portion 710. Particularly, for example, the dust collecting module 900 may include a dust filter 910 that filters and collects dusts entrained in air flowing through the lighting fixture, and a filter housing 920 connects the dust filter 910 to the dust collecting module support portion 710. The filter housing unit 920 may have, for example, a 'U' shaped cross section to receive the dust filter 910, and have a plurality of filter ventilation holes 922 disposed apart from each other so that air passing through the dust filter 910 may pass through the filter ventilation holes 922.

The dust collecting module 900 may be formed corresponding to the inner side face of the reflector 700 in addition to the outer side face of the reflector 700 to filter and collect dusts included in air inside the reflector 700. In addition, the dust collecting module 900 may extend up and down based on the reflector 700, or have an 'L' curved shape at the lower end portion of the reflector 700. In addition, the height of the dust collecting module 900 may be controlled according to the shape of the lower end portion 100*a* of the housing 100 or the location of the outer vent 110.

In normal operation air flow is generated when the fan 400 rotates in a clockwise direction.

First, the air flowing in the case body 100 through the side inlet 252 formed between the upper cover 250 and the end of the case body 100 is blown into the heat sink 300 by the fan 400. The heat sink 300 is absorbing the heat generated from the light source module 500, and cooling ambient air blown into the heat sink 300 absorbs heat from the heat sink 300 to reduce the temperature of the heat sink 300.

Some of the air blown into and over the heat sink 300 by the fan 400 is directed to the outer side face of the reflector 700 through the outer vent 110 formed at the lower end of the case body 100, to pass through the dust collecting module 900. As a result, dust, air entrained particulates, and other foreign substances that is included in the air adheres to the outer side face of the reflector 700 and may be collected by the dust collecting module 900, and removed. Thus, the dust collecting module 900 may remove dust included in the air, to thereby at least partially clean air in a factory or a workplace environment.

A path is formed in the housing HS to move the air blown over the heat sink 300 under the light source module 500 by the fan 400. The air flow path may be formed by the heat sink vent 312, the light source vent 512 and the plate vent. Thus, the air, which moves under the light source module 500 through the air path, may move dust downwardly again, which moves from the lower portion of the lighting apparatus 1000 to the light source module 500, to thereby prevent the dusts from sticking to the outer side face of the reflector 700.

Modifications applied to the present embodiment may be applied to the other previous embodiments.

Embodiment 10

Figure 16:
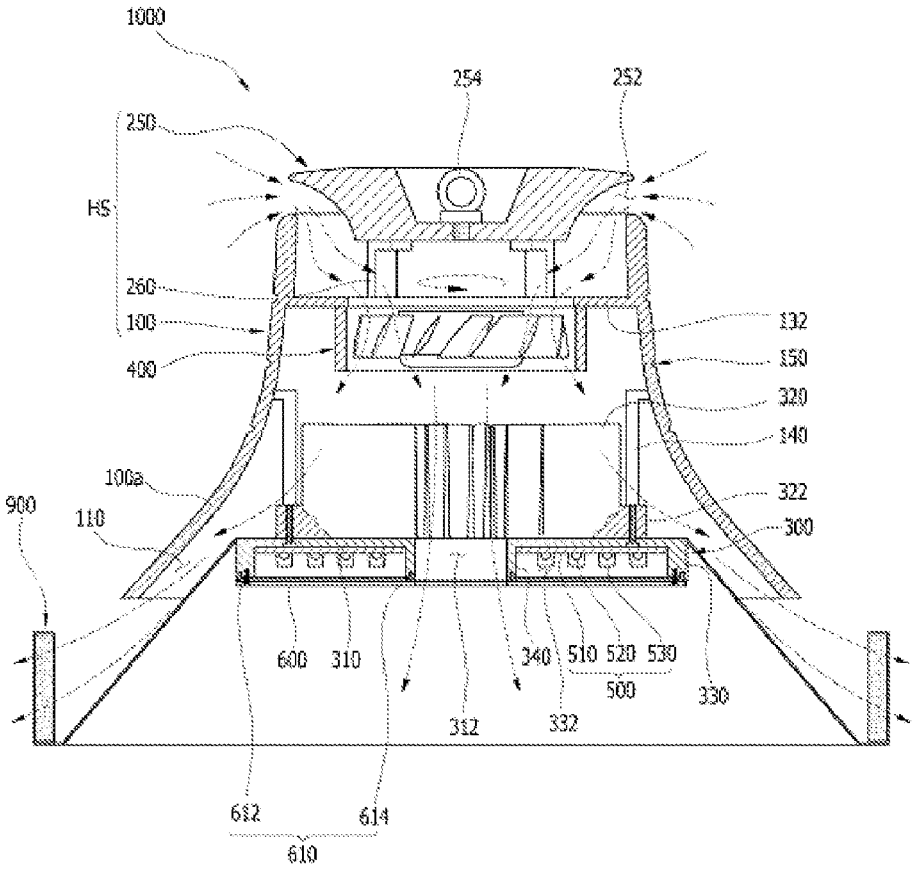
FIG. 16 is a cross sectional view illustrating an optical semiconductor lighting apparatus according to a tenth embodiment of the present invention.

FIG. 16 is a cross sectional view illustrating an optical semiconductor lighting apparatus according to a tenth embodiment of the present invention.

An optical semiconductor lighting apparatus 1000 shown in FIG. 16 is substantially the same as the lighting apparatus 1000 of the ninth embodiment described in FIGS. 12 to 15 except for a portion of the case body 100 and the reflector 700. Thus, any further description for substantially the same elements as the ninth embodiment will be omitted, and the same reference numerals as the ninth embodiment will be given to substantially the same elements.

Referring to FIG. 16, the lower end portion 100*a* of the case body 100 is flared outwardly from the outer side face of the reflector 700 and overlaps the outer side face of the reflector 700. The lower end portion 100*a* of the case body 100 may cover ⅓ or ½ of the outer side face of the reflector 700 from the upper end thereof, and alternatively cover the entire portion of the outer side face of the reflector 700, which is not shown in FIG. 16. In addition, the lower end portion 100*a* of the case body 100 may have an inclination substantially the same as or a little greater/smaller than the inclination of the outer side face of the reflector 700. An outer vent 110 is formed between the lower end portion 100*a* of the case body 100 and the reflector 700.

The reflector 700 may be coupled to and fixed to the side face of the base plate 310, and the upper end of the reflector 700 may be disposed coincident with the upper end of the side face of the base plate 310.

According to the present embodiment, the lower end portion 100*a* of the case body 100 is disposed outside of the outer side face of the reflector 700 to overlap the outer side face of the reflector 700. An outer vent 110 is thus formed and some of the air blown through the heat sink 300 by the fan 400 may move along the outer side face of the reflector 700 when flowing out through the outer vent 110, and as a result, dust, air entrained particulates, and other foreign substances which may tend to accumulate on the outer side face of the reflector 700 may be effectively removed.

In addition, the upper end of the reflector 700 is disposed coincident with the upper end of the side face of the base plate 310 of the heat sink 300, and thus air flowing out through the outer vent 110 may move to the lower end of the outer side face of the reflector 700 via the upper end of the outer side face of the reflector 700. As a result, dust and other, foreign substances accumulated on the upper end portion of the outer side face of the reflector 700 may be effectively removed.

Modifications applied to the present embodiment may be applied to the other previous embodiments.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An optical semiconductor lighting apparatus comprising:

a housing comprising a first end portion and an opposing second end portion, wherein the first and second end portions comprise an upper cover and a case body coupled to the upper cover, respectively;

a light source module disposed inside the housing;

a fan disposed inside the housing and adjacent to the light source module, wherein the fan rotates in a first direction to blow air toward the light source module; and a reflector disposed adjacent to the second end portion of the housing, wherein:

the reflector comprises a first surface configured to reflect light emitted from the light source module and an opposing second surface that is exposed to ambient air; and the reflector is coupled to the second end portion of the housing with an outer vent formed therebetween, wherein the housing at least partially defines an inlet passage along which air is drawn between the first and second end portions of the housing by the fan, moved past the light source, and exhausted from the housing through the outer vent and elected over the second surface of the reflector, when the fan moves in the first direction;

wherein the light source module comprises:

a printed circuit board comprising a vent forming a portion of the moving path; and at least one optical semiconductor element mounted on the printed circuit board;

wherein the vent comprises:

a middle vent formed through a center portion of the printed circuit board; and a peripheral vent formed at an peripheral portion of the printed circuit board.

2. The optical semiconductor lighting apparatus of claim 1, further comprising a heat sink configured to dissipate heat generated by the light source module, wherein the heat sink comprises:

a base plate comprising a heat sink vent; and a heat dissipation protrusion protruding from the base plate.

3. The optical semiconductor lighting apparatus of claim 1, wherein the peripheral vent is formed to be inclined toward an interior surface of the reflector.

4. The optical semiconductor lighting apparatus of claim 1, further comprising a dust collecting module configured to collect dust removed from the reflector.

5. The optical semiconductor lighting apparatus of claim 1, further comprising a lighting controller configured to control the fan and the light source module.

6. The optical semiconductor lighting apparatus of claim 5, wherein the lighting controller controls the light source module to inform of a malfunction of the fan when the fan does not rotate or rotates at a speed lower than a threshold.

7. The optical semiconductor lighting apparatus of claim 5, wherein the lighting controller controls the fan to rotate in a second direction opposite to the first direction for removing dust accumulated near an air inlet formed at the housing.

8. The optical semiconductor lighting apparatus of claim 1, wherein:

the case body comprises the fan and the light source module disposed therein and having a upper portion and a lower portion which are open; and the upper cover is coupled with the case body to cover the upper portion of the case body.

9. The optical semiconductor lighting apparatus of claim 8, wherein the upper cover is separated from the upper portion of the case body to form a peripheral inlet through which outside air flows into the housing.

10. The optical semiconductor lighting apparatus of claim 8, wherein a plurality of stripe protrusions or a plurality of stripe grooves separated from one another is formed on an exterior surface of the case body.

11. The optical semiconductor lighting apparatus of claim 2, wherein the heat sink further comprises a middle protrusion wall forming the middle vent.

12. The optical semiconductor lighting apparatus of claim 2, wherein the heat sink further comprises a middle protrusion wall separating the middle vent and the peripheral vent.

13. The optical semiconductor lighting apparatus of claim 11, wherein the printed circuit board surrounds the middle protrusion wall.

* * * * *